US009594317B2

(12) United States Patent
Takezawa et al.

(10) Patent No.: US 9,594,317 B2
(45) Date of Patent: Mar. 14, 2017

(54) ORGANIC PHOTORECEPTOR, AND ELECTROPHOTOGRAPHIC CARTRIDGE AND ELECTROPHOTOGRAPHIC IMAGING APPARATUS INCLUDING THE SAME

(71) Applicant: Samsung Electronics Co., Ltd., Suwon-si, Gyeonggi-do (KR)

(72) Inventors: Manabu Takezawa, Kanagawa (JP); Adachi Mami, Kanagawa (JP); Osamu Watanabe, Kanagawa (JP); Tomohito Chokan, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/593,666

(22) Filed: Jan. 9, 2015

(65) Prior Publication Data

US 2015/0192869 A1 Jul. 9, 2015

(30) Foreign Application Priority Data

Jan. 9, 2014 (JP) ..... 2014-002352
Dec. 19, 2014 (KR) ..... 10-2014-0184965

(51) Int. Cl.
*G03G 5/147* (2006.01)

(52) U.S. Cl.
CPC ..... *G03G 5/14734* (2013.01); *G03G 5/1473* (2013.01); *G03G 5/1476* (2013.01); *G03G 5/14769* (2013.01); *G03G 5/14791* (2013.01); *G03G 5/14795* (2013.01)

(58) Field of Classification Search
CPC ..... G03G 5/1476; G03G 5/14769; G03G 5/14734; G03G 5/14791; G03G 5/0575; G03G 5/0546
USPC ..... 430/66, 59.6
See application file for complete search history.

(56) References Cited

U.S. PATENT DOCUMENTS 8,940,466 B2 * 1/2015 Bellino ..... G03G 5/14786 430/66
2011/0183243 A1 * 7/2011 Ahn ..... G03G 5/144 430/56
2011/0318681 A1 12/2011 Osada et al.
2014/0186757 A1 * 7/2014 Reeves ..... G03G 5/14786 430/66
2015/0168908 A1 * 6/2015 Black ..... G03G 5/0575 430/56

(Continued)

FOREIGN PATENT DOCUMENTS

EP 0532243 9/1992
JP 9297423 11/1997

(Continued)

OTHER PUBLICATIONS

English language machine translation of JP 2010-276699 (Dec. 2010).*

*Primary Examiner* — Christopher Rodee
(74) *Attorney, Agent, or Firm* — NSIP Law

(57) ABSTRACT

An organic photoreceptor including a photosensitive layer disposed on an electrically conductive substrate; and a protective layer disposed on the photosensitive layer, wherein the protective layer includes a cured product of a multifunctional acrylic oligomer including a urethane group and a multifunctional curable compound including a dendrimeric structure.

10 Claims, 4 Drawing Sheets

(56) References Cited

U.S. PATENT DOCUMENTS

| | | | | |
|---|---|---|---|---|
| 2015/0185631 | A1* | 7/2015 | Black | G03G 5/0542 430/58.3 |

FOREIGN PATENT DOCUMENTS

| | | |
|---|---|---|
| JP | 2005010476 | 1/2005 |
| JP | 2005338222 | 12/2005 |
| JP | 200890118 | 4/2008 |
| JP | 2009229988 | 10/2009 |
| JP | 2010276699 | 12/2010 |
| JP | 2012189976 | 10/2012 |
| JP | 201361625 | 4/2013 |

* cited by examiner

ORGANIC PHOTORECEPTOR, AND ELECTROPHOTOGRAPHIC CARTRIDGE AND ELECTROPHOTOGRAPHIC IMAGING APPARATUS INCLUDING THE SAME

CROSS-REFERENCE TO RELATED APPLICATIONS

This application claims priority to Japanese Patent Application No. 2014-002352, filed on Jan. 9, 2014, and Korean Patent Application No. 2014-0184965, filed on Dec. 19, 2014, in the Korean Intellectual Property Office, and all the benefits accruing therefrom under 35 U.S.C. §119, the contents of which are incorporated herein in their entirety by reference.

BACKGROUND

1. Field

The present disclosure relates to an organic photoreceptor, and an electrophotographic cartridge and an electrophotographic imaging apparatus each including the organic photoreceptor.

2. Description of the Related Art

Organic photoreceptors (OPCs) have advantages such as (1) good optical characteristics, including a wide optical absorption wavelength range and large optical absorption amount, (2) good electrical characteristics such as high sensitivity and stable charging characteristics, (3) a wide selection range of various source materials, and (4) are convenient to manufacture with low manufacturing costs. Given these advantages, organic photoreceptors are widely used instead of inorganic photoreceptors in copying machines, fax machines, laser printers, and multifunction peripherals (MFPs).

Recently, due to the requirements for high-speed and maintenance-free electrophotographic imaging apparatuses, there has been a demand for a photoreceptor with high durability. A conventional organic photoreceptor includes a low-molecular weight charge transporting material and an organic polymer material, such as a polycarbonate, as main components, and thus is soft. Accordingly, the surface of such organic photoreceptor may be easily worn out when repeatedly used in an electrophotographic process due to a mechanical load by a developing system or a cleaning system. In addition, due to the use of toner particles of smaller size to obtain high-quality images, there also has been a need to improve the cleaning characteristics of the photoreceptor. This need, however, may increase the hardness of a cleaning blade made of a rubber and a pressure exerted on a surface of the photoreceptor contacting the cleaning blade, and thus may further facilitate surface abrasion and damage of the photoreceptor. Such abrasion and damage of the photoreceptor may deteriorate electrical characteristics thereof, leading to a reduced sensitivity and reduced charging characteristics, and consequently to a low image concentration and poor image quality. In addition, local damage of the photoreceptor may deteriorate the cleaning characteristics of the photoreceptor, leaving a stripped stain on the produced image. Accordingly, the lifespan of the photoreceptor may depend on the rate of deterioration caused by such abrasion or damage.

Therefore, to improve the durability of the organic photoreceptor, it is desirable to reduce a surface abrasion loss and improve scratch resistance thereof, which is a prerequisite for improving the resistance to plate wear of the organic photoreceptor. Technologies for improving wear resistance include forming a protective layer on a surface of the photoreceptor using a thermocurable resin as disclosed in Japanese Patent Publication No. 2013-061625, Japanese Patent Publication No. 2012-189976, and Japanese Patent Publication No. 2009-229988.

However, these conventional technologies form a high-hardness protective layer of a photoreceptor by crosslinking a low-molecular weight multifunctional polymerizable acrylic monomer at a high crosslinking density so as to reduce surface abrasion loss of the photoreceptor. The formation of the high-hardness protective layer may reduce the surface abrasion loss of the photoreceptor due to a high surface hardness of the photoreceptor. However, as polymerizable groups (for example, acryloyl groups) of the polymerizable acrylic monomer form covalent crosslink bonds therebetween, severe shrinkage may occur due to a large intermolecular distance gap before and after curing. This shrinkage may highly increase the internal stress of the protective layer of the photoreceptor and brittleness so that the protective layer is more prone to breakage. Therefore, when a photoreceptor has a partial surface defect such as a scratch, the partial surface defect may extend over the photoreceptor, consequently resulting in large scratches or cracks and deteriorating the mechanical durability of the photoreceptor.

Thus, there remains a need in a protective layer having high hardness, high toughness, high elasticity, and good internal stress relaxation characteristics.

SUMMARY

Provided is an organic photoreceptor with a protective layer including a composite structure, wherein the composite structure is capable of exhibiting conflicting characteristics including high hardness, high elasticity, and good internal stress relaxation.

Provided is an electrophotographic cartridge including the organic photoreceptor.

Provided is an electrophotographic imaging apparatus including the organic photoreceptor.

Additional aspects will be set forth in part in the description which follows and, in part, will be apparent from the description, or may be learned by practice of the presented embodiments.

According to an aspect of the present disclosure, an organic photoreceptor includes:

a photosensitive layer disposed on an electrically conductive substrate; and a protective layer disposed on the photosensitive layer, wherein the protective layer includes a cured product of a multifunctional acrylic oligomer having a urethane group and a multifunctional curable compound having a dendrimeric structure.

The multifunctional acrylic oligomer may have 2 to 6 polymerizable functional groups, may be soluble in an alcoholic solvent, and may have a number average molecular weight of about 500 Daltons to about 4,000 Daltons, wherein at least one of the polymerizable functional groups may be selected from a radical-polymerizable (meth)acryloyl group and a vinyl group.

The multifunctional acrylic oligomer may be a urethane (meth)acrylate oligomer having a urethane group.

The multifunctional curable compound having a dendrimeric structure may be a polyester(meth)acrylate or a copolymeric poly(meth)acrylate having a peak in a molecular weight range of about 1,000 Daltons or greater to about 25,000 Daltons or less in a molecular weight distribution curve obtained by using a gel permeation chromatography (GPC) method.

An amount of residues derived from the multifunctional curable compound having a dendrimeric structure may be less than 100 parts by mass based on 100 parts by mass of all residues derived from the multifunctional acrylic oligomer.

The protective layer may further include a conductive particle to maintain electrical characteristics of the organic photoreceptor.

The photosensitive layer may be a laminated photosensitive layer including a charge generating layer including a charge generating material and a charge transporting layer including a charge transporting material, wherein the charge generating layer is laminated on the electrically conductive substrate, and wherein the electrically conductive substrate is laminated on the charge generating layer.

Alternatively, the photosensitive layer may be a single-layered photosensitive layer disposed on the electrically conductive substrate, wherein the single-layered photosensitive layer includes a charge generating material and a charge transporting material.

The organic photoreceptor may further include an intermediate layer disposed between the photosensitive layer and the electrically conductive substrate.

According to another aspect of the present disclosure, provided is an electrophotographic cartridge including an organic photoreceptor according to the above-described embodiments.

According to another aspect of the present disclosure, provided is an electrophotographic imaging apparatus including an organic photoreceptor according to the above-described embodiments.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
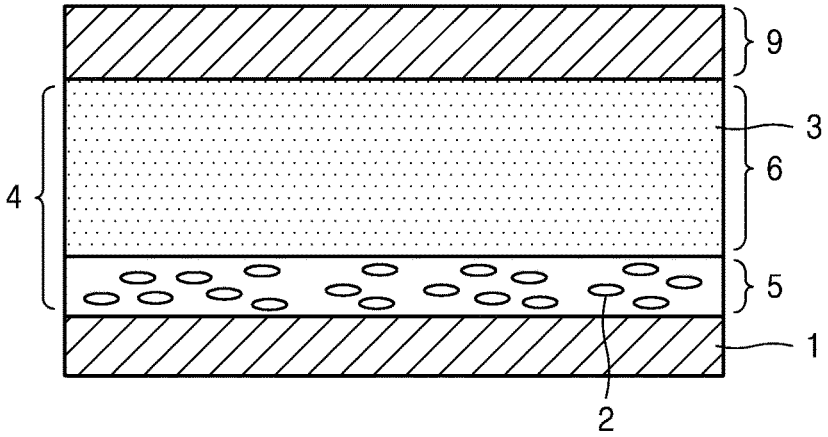
FIG. 1 is a schematic cross-sectional view illustrating a structure of an organic photoreceptor according to an embodiment.

Reference will now be made in detail to embodiments of an organic photoreceptor, and an electrophotographic cartridge and an electrophotographic imaging apparatus, each including the organic photoreceptor, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed. Expressions such as "at least one of," when preceding a list of elements, modify the entire list of elements and do not modify the individual elements of the list.

It will be understood that when an element is referred to as being "on" another element, it can be directly in contact with the other element or intervening elements may be present therebetween. In contrast, when an element is referred to as being "directly on" another element, there are no intervening elements present.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present embodiments.

The terminology used herein is for the purpose of describing particular embodiments only and is not intended to be limiting. As used herein, the singular forms "a," "an," and "the" are intended to include the plural forms as well, unless the context clearly indicates otherwise.

It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

According to an aspect of the present disclosure, an organic photoreceptor includes a photosensitive layer disposed on an electrically conductive substrate, and a protective layer disposed on the photosensitive layer.

The organic photoreceptor may have any layered structure in which an organic photosensitive layer and a protective layer are laminated on the electrically conductive substrate in the stated order. For example, the organic photoreceptor may have one of the following layered structures (1) and (2):

(1) a layered structure in which an intermediate layer, an organic photosensitive layer consisting of a laminated layer including a charge generating layer and a charge transporting layer, and a protective layer are laminated on the electrically conductive substrate in the stated order; and (2) a layered structure in which an intermediate layer, an organic photosensitive layer consisting of a single layer including a charge generating material and a charge transporting material, and a protective layer are laminated on the electrically conductive substrate in the stated order.

These photosensitive layers will be described in greater detail later.

In some embodiments, the organic photoreceptor may further include an intermediated layer disposed between the photosensitive layer and the electrically conductive substrate to maintain the electrical characteristics of the organic photoreceptor. The intermediate layer formed on the electrically conductive substrate may improve image characteristics by suppressing hole injection, improve adhesiveness between the electrically conductive substrate and the photosensitive layer, and prevent dielectric breakdown.

Hereinafter, embodiments of the protective layer of the organic photoreceptor will now be described.

The protective layer may be obtained by curing a coated layer of a protective layer forming composition (coating solution) that includes a polymerizable compound for forming a cured resin material constituting the protective layer and a metal oxide particle. For example, the protective layer may include a cured product of a multifunctional acrylic oligomer having a urethane group (—NH—C(═O)—O—) and a multifunctional curable compound having a dendrimeric structure. As used herein, the term "multifunctional acrylic oligomer having a urethane group" refers to an oligomer including a urethane group as defined above and at least one polymerizable group.

The multifunctional acrylic oligomer may have 2 to 6 polymerizable functional groups, in addition to a urethane group, wherein at least one of the polymerizable functional groups may be selected from a radical-polymerizable (meth) acryloyl group and a vinyl group. As used herein, the term "(meth)acryloyl group" refers to both methacryloyl group having molecular formula $H_2C{=}C(CH_3){-}C({=}O){-}O{-}$ and acryloyl group having molecular formula $H_2C{=}C(H){-}C({=}O){-}O{-}$. As used herein, the term "vinyl group" refers to a group having molecular formula $H_2C{=}CH{-}$. In addition, the multifunctional acrylic oligomer may be soluble in an alcoholic solvent.

The multifunctional acrylic oligomer may be an oligomer having a (meth)acryloyl group and/or a vinyl group as a functional group included in a molecular structure thereof. For example, the multifunctional acrylic oligomer may be an oligomer having 2 to 6 of these functional groups or having 3 to 6 these functional groups. For example, the multifunctional acrylic oligomer may be an oligomer having 2 to 6 (meth)acryloyl groups. The multifunctional acrylic oligomer may have a number average molecular weight (Mn) of about 500 Daltons to about 4,000 Daltons, for example, about 1,000 Daltons to about 4,000 Daltons. When the multifunctional acrylic oligomer has a number average molecular weight (Mn) of 500 Daltons or larger, a cured product thereof may have no brittleness or little brittleness. When the multifunctional acrylic oligomer has a number average molecular weight (Mn) of 4,000 Daltons or less, a cured product thereof may have good hardness, strength, toughness, and durability because the crosslinked structure thereof does not become loose. The multifunctional acrylic oligomer may have a weight average molecular weight (Mw) of about 1,000 Daltons or greater to about 8,000 Daltons or less, and in some embodiments, about 1,800 Daltons or greater to about 7,200 Daltons or less, and in some embodiments, about 1,600 Daltons or greater to about 6,400 Daltons or less, and in some embodiments, about 1,500 Daltons or greater to about 6,000 Daltons or less, and in some embodiments, about 1,400 Daltons or greater to about 5,600 Daltons or less, and in some other embodiments, about 1,300 Daltons or greater to about 5,200 Daltons or less, and in some other embodiments, about 1,200 Daltons or greater to about 4,800 Daltons or less, and in some other embodiments, about 1,100 Daltons or greater to about 4,400 Daltons or less. In the present disclosure, due to a high molecular weight effect resulted from the use of the multifunctional acrylic oligomer having a large molecular weight, instead of a low-molecular weight polymerizable monomer, as a starting material for curing (crosslinking), i.e., due to both having a crosslinked cured structure having an entangled structure between linear or branched oligomer molecules and a physical crosslinked structure by hydrogen bonding forces between urethane groups, the organic photoreceptors having an improved toughness and scratch resistance can be obtained.

The multifunctional acrylic oligomer having a urethane group may be a multifunctional acrylic oligomer that is soluble in an alcoholic solvent in which a charge transporting material and a binder resin of the photosensitive layer underlying the protective layer have poor solubility.

The multifunctional acrylic oligomer may be a urethane (meth)acrylate oligomer having a urethane group. The urethane (meth)acrylate oligomer may be commercially available or prepared for use by reacting, for example, a urethane prepolymer with isocyanate end-groups, which may be obtained by reacting a polyol and a molar excess amount of an isocyanate compound, with a (meth)acrylate monomer having a hydroxyl group.

Examples of the isocyanate compounds that may be used include, but are not limited thereto, xylene diisocyanate, toluene diisocyanate, tetramethyl xylene diisocyanate, and isophorone diisocyanate.

Examples of the polyols that may be used include, but are not limited thereto, ethylene glycol, propylene glycol, 1,4-butylene glycol, or polyester polyols that may be obtained by ring opening polymerization of a cyclic ester compound, such as caprolactone; and polyether polyols obtained by polymerization of ethylene oxide or propylene oxide.

Non-limiting examples of the (meth)acrylate monomer having a hydroxyl group include, but are not limited thereto, 2-hydroxymethyl(meth)acrylate, 2-hydroxyethyl(meth) acrylate, dipentaerythritol penta/hexa(meth)acrylate, trimethylolpropane tri(meth)acrylate, and trimethylol propane ethoxylate tri(meth)acrylate.

For example, the urethane (meth)acrylate oligomer may be prepared as follows. First, a molar excess amount of 2,4-toluene diisocyanate (TDI) is reacted with polypropylene glycol (PPG) under the presence of a catalyst such as dibutyltin dilaurate (DBTDL) or stannous octoate in a N,N'-dimethylformamide (DMF) solvent to obtain a urethane prepolymer. This reaction may be performed, for example, in a dry inert gas atmosphere at about 60° C. for about 6 hours. After the mixture containing the resulting urethane prepolymer is cooled down to about 40° C., 2-hydroxyethyl(meth)acrylate is added and the mixture is then further reacted for about 2 hours until the isocyanate group is completely removed, to obtain a urethane (meth)acrylate oligomer.

The multifunctional curable compound having a dendrimeric structure, which does not belong to the multifunctional acrylic oligomer having a urethane group, may be a polyester(meth)acrylate or a copolymer poly(meth)acrylate having a peak in a molecular weight range of about 1,000 Daltons or greater to about 25,000 Daltons or less in a molecular weight distribution curve obtained by using a gel permeation chromatography (GPC) method.

The cured product may be obtained by adding about 100 parts by mass or less, for example, about 5 parts by mass to about 100 parts by mass, and in some embodiments, about 10 parts by mass to about 100 parts by mass of the multifunctional curable compound having a dendrimeric structure, based on 100 parts by mass of the multifunctional acrylic oligomer. In some other embodiments, to reduce the sliding resistance of the protective layer of the organic photoreceptor, the cured product may be obtained by further adding about 30 parts by mass or less, for example, about 5 parts by mass to about 30 parts by mass, and in some embodiments, about 5 parts by mass to about 20 parts by mass of a fluorinated polymerizable monomer, based on 100 parts by mass of the multifunctional acrylic oligomer. Non-limiting examples of the fluorinated polymerizable monomer include, but are not limited thereto, 2,2,2-trifluoroethyl (meth)acrylate, 2-perfluorohexyl ethyl(meth)acrylate, and methyl 2-(trifluoromethyl)(meth)acrylate.

The protective layer of the organic photoreceptor may be provided with conflicting characteristics of high hardness and good internal stress relaxation by introducing molecules of a multifunctional curable compound having a dendrimeric structure into a crosslinked structure of high-molecular weight multifunctional acrylic oligomers, making it a composite structure, so that high intramolecular and intermolecular bonding density regions and low intramolecular and intermolecular bonding density regions of dendrimer molecules having a spherical configuration are uniformly formed. The dendrimeric structure of the multifunctional curable compound according to the present disclosure is a homogeneous hyperbranched steric structure having a spherical configuration that is distinct from a common hyperbranched structure having an inhomogeneous hyperbranched steric structure. Due to this homogeneous dendrimeric structure, the organic photoreceptor may have improved characteristics, and particularly, improved mechanical characteristics.

As described above, the organic photoreceptors according to the above-described embodiments may have high hardness, toughness, internal stress relaxation characteristics, and improved long-term mechanical durability (resistance to plate wear, scratch resistance, and surface wear resistance), and thus may provide high-quality electrophotographic images.

The multifunctional curable compound having a dendrimeric structure may be an oligomer having a dendrimeric structure including at least one selected from a (meth) acryloyl group and a (meth)acryloyloxy group (hereinafter, also referred to as a "dendrimeric oligomer") at a terminal thereof. The dendrimeric oligomer including at least one selected from a (meth)acryloyl group and a (meth)acryloyloxy group at a terminal thereof may be a radical-polymerizable oligomer having at least 6 radical-polymerizable functional groups selected from a (meth)acryloyl group and a (meth)acryloyloxy group and having a dendrimeric structure in a molecular structure thereof. For example, the radical-polymerizable oligomer may have a polyester backbone.

The dendrimeric structure refers to a hyperbranched structure with branched molecular structures, as a basic unit, repetitively branched starting from a core molecule of the multifunctional compound. For example, the dendrimeric oligomer may be a tree-like hyperbranched oligomer with multiple branches, typically symmetric around the core molecule. The dendrimeric oligomer may be a dendrimeric oligomer having functional groups repetitively branched starting from a dipentaerythritol core.

The dendrimeric oligomer may have an average number of radical-polymerizable functional groups of 6 or more, and in some embodiments, 9 or more, and in some other embodiments, 12 or more. When the average number of radical-polymerizable functional groups is less than 6, the effect of a loose-dense structure having both a hard segment portion including a dendrimer core having a high bonding density and a soft segment portion including dendrimer branches having a low bonding density are small so that high elasticity and high internal stress relaxation characteristics may not sufficiently be provided to the protective layer.

The radical-polymerizable dendrimeric oligomer may be synthesized or may be commercially available for use.

The radical-polymerizable dendrimeric oligomer may be synthesized as follows. First, a radical-polymerizable dendrimeric oligomer may be obtained by self-condensation of molecules having at least three functional groups of two different functional groups. For example, a dendrimeric polyester may be obtained by polycondensation of 3,5-dihydroxybenzoic acid as a source material. A hydroxyl terminal group of the dendrimeric polyester may then be reacted with (meth)acrylic acid to obtain a radical-polymerizable oligomer having a dendrimer structure. In some embodiments, a radical-polymerizable oligomer having a dendrimeric structure may be obtained by coupling 2-(4-benzoyl-3-hydroxyphenoxy)ethyl acrylate with 5-hydroxyisophthalic acid (first step), and then coupling the resulting product with trimesic acid (second step).

Examples of commercially available dendrimeric oligomers are, but are not limited thereto, "VISCOAT #1000" and "STAR-501" (available from Osaka Organic Chemical Ind., Ltd.). "VISCOAT #1000" and "STAR-501" are dendrimeric oligomers having functional groups repetitively branched from a dipentaerythritol core. "VISCOAT #1000" includes, as a dilute monomer, ethylene glycol diacrylate, has a viscosity of about 273 milliPascal-seconds (mPa·s), and includes 14 functional groups (acryloyl groups). "STAR-501" includes, as a dilute monomer, dipentaerythritol hexaacrylate, has a viscosity of about 210 mPa·s, and includes 20 to 99 functional groups (acryloyl groups). "VISCOAT #1000" and "STAR-501" both include acryloyl groups on an outermost surface thereof, which may take part in polymerization therebetween or reaction with a multifunctional acrylic oligomer having a urethane group.

In some embodiments, the multifunctional curable compound having a dendrimeric structure may be a polyester (meth)acrylate or a copolymeric poly(meth)acrylate having a peak in a molecular weight range of about 1,000 Daltons or greater to about 25,000 Daltons or less in a molecular weight distribution curve obtained by using a gel permeation chromatography (GPC) method. The copolymeric poly (meth)acrylate may be a crosslinkable polymer having at least two epoxy groups as reactive groups in a molecule thereof. For example, the multifunctional curable compound having a dendrimeric structure may be a poly(meth)acrylate obtained by copolymerization of glycidyl(meth)acrylate.

The number average molecular weights (Mn) and weight average molecular weights (Mw) of the multifunctional acrylic oligomer having a urethane group and the multifunctional curable compound having a dendrimeric structure may be determined, for example, by gel permeation chromatography (GPC) involving eluting an oligomer solution through a crosslinked styrene-divinylbenzene column and calibration based on a specified polystyrene (PS) standard. For example, the oligomer sample solution for GPC measurement may be prepared by dissolving the multifunctional acrylic oligomer having a urethane group in a solvent such as DMF, dimethyl acetamide, methanol, ethanol, and isopropanol at a concentration of about 1 milligrams per milliliter (mg/mL) and may be eluted at a flow rate of about 0.2 to 1.0 milliliters per minute (mL/min).

According to the present disclosure, the protective layer of the organic photoreceptor may include a composite structure obtained by introducing a polymerization product of a multifunctional curable compound having a dendrimeric structure into a 3-dimensional crosslinked structure obtained from the reaction of multifunctional acrylic oligomers having a urethane group, and thus may have conflicting characteristics including high hardness, as well as high toughness, high elasticity, and good internal stress relaxation.

Accordingly, the organic photoreceptor including the protective layer may have improved durable mechanical characteristics such as resistance to plate wear, scratch resistance, and wear resistance. Therefore, the organic photoreceptor according to any of the above-described embodiments may consistently provide high-quality images even when repeatedly used for a long period of time.

The protective layer may further include a conductive particle such as a metal particle and/or a conductive metal oxide particle to maintain the electrical characteristics of the organic photoreceptor. Non-limiting examples of the conductive particle are particles of at least one selected from copper, tin, aluminum, indium, silica, tin oxide, zinc oxide, titanium dioxide, aluminum oxide ($Al_2O_3$), zirconium oxide, indium oxide, antimony oxide, bismuth oxide, calcium oxide, antimony tin oxide (ATO), and carbon nanotubes.

The protective layer may include a photocured product of a protective layer forming composition including the multifunctional acrylic oligomer having a urethane group, the multifunctional curable compound having a dendrimeric structure, a photoinitiator, a conductive particle, and a solvent.

The amount of the conductive particle in the protective layer forming composition may be in a range of about 5 parts to about 40 parts by mass, and in some embodiments, about 15 parts to about 25 parts by mass, based on 100 parts by mass of a total mass of the multifunctional acrylic oligomer having a urethane group and the multifunctional curable compound having a dendrimeric structure. When the amount of the conductive particle is within the range of about 5 parts to about 40 parts by mass, the protective layer may have sufficient charge transport ability, and may consequently prevent a residual potential increase caused due to reduced sensitivity, and may have improved charging ability and mechanical strength. The amount of the conductive particle in the protective layer forming composition is equivalent to the amount of the conductive particle in the protective layer, since the protective layer is formed by evaporating the solvent of the protective layer forming composition.

The photoinitiator may be any compound, which is capable of generating active species upon exposure to an actinic radiation, for example, visible rays, UV rays, far UV rays, or charged particle beams to initiate polymerization of such photocurable compounds as described above. Non-limiting examples of the photoinitiator are an O-acyl oxime compound, an acetophenone compound, diimidazole compound, a benzoin compound, a benzophenone compound, an α-diketone compound, a polynuclear quinone compound, a xanthone compound, a phosphine compound, and a triazine compound.

Non-limiting examples of commercially available photoinitiator products are those that can be purchase under the trade name of IRGACURE 127, IRGACURE 184, IRGACURE 819, IRGACURE 907, or IRGACURE 754.

The amount of the photoinitiator may be in a range of about 1 part to about 20 parts by mass, and in some embodiments, about 2 parts to about 10 parts by mass, based on 100 parts by mass of a total mass of the multifunctional acrylic oligomer having a urethane group and the multifunctional curable compound having a dendrimeric structure. When the amount of the photoinitiator is within the range of about 1 part to about 20 parts by mass, sufficient curing may occur to form a protective layer having sufficient hardness, increased mechanical strength, and consequently improved wear resistance.

Non-limiting examples of the solvent for the protective layer forming composition are aromatic hydrocarbons such as benzene, xylene, monochlorobenzene, and dichlorobenzene; ketones such as acetone, methyl ethyl ketone, and cyclohexanone; alcohols such as methanol, ethanol, 1-propanol, isopropanol, n-propanol, and n-butanol; esters such as ethyl acetate and methyl cellosolve; aliphatic halogenated hydrocarbons such as carbon tetrachloride, chloroform, dichloromethane, dichloroethane, and trichloroethylene; ethers such as tetrahydrofuran, dioxane, dioxolane, and ethylene glycol monomethyl ether; amides such as N,N-dimethyl formamide (DMF) and N,N-dimethyl acetamide; and sulfoxides such as dimethylsulfoxide. These solvents may be used alone or in a combination of at least two thereof.

The amount of the solvent may be in a range of about 150 parts to about 700 parts by mass, and in some embodiments, about 400 parts to about 600 parts by mass, based on 100 parts by mass of a total mass of the multifunctional acrylic oligomer having a urethane group and the multifunctional curable compound having a dendrimeric structure. When the amount of the solvent is within the range of about 150 parts to about 700 parts by mass, the solvent may dissolve each component in the protective layer forming composition to form a homogeneous solution, and may be completely removed to form the protective layer with improved wear resistance.

The protective layer may be formed via coating, drying, and photocuring steps. First, the coating may be performed by any known coating method, such as dip coating, spray coating, spin coating, wire bar coating, or ring coating, but are not limited thereto. The drying after coating may be performed at a temperature of about 50° C. to about 200° C. for about 5 minutes to about 30 minutes. After the drying to evaporate the solvent, photocuring may be performed using a photocuring system by, for example, UV curing. Upon exposure to actinic radiation, radicals may be generated to cause polymerization and intermolecular and intramolecular crosslinking reactions so that a cured product with intermolecular and intramolecular crosslinked bonds may be obtained. The actinic radiation may be UV rays or an electron beam. A radiation device such as a known UV radiation device or electron beam radiation device, but are not limited thereto, may be appropriately used to form the protective layer.

The organic photoreceptor may be rotated for uniform curing. For example, the rotation speed may be in a range of about 5 revolutions per minute (rpm) to about 40 rpm, and in some embodiments, about 20 rpm. The curing time may vary depending on the thickness of the protective layer and the rotation speed of the organic photoreceptor. For example, the curing time may be in a range of about 20 seconds to about 100 seconds. When the curing time is within the range of about 20 seconds to about 100 seconds, damage or sensitivity reduction of the organic photoreceptor resulting from incomplete curing or overcuring may be prevented.

The protective layer formed as described above may have a thickness of about 0.5 micrometers (μm) to about 10 μm, and in some embodiments, about 0.5 μm to about 4 μm. When the thickness of the protective layer is within the range of about 0.5 μm to about 10 μm, the thickness of the protective layer may be sufficient to protect the photosensitive layer in order to prevent deterioration of print image quality.

In some embodiments, the organic photoreceptor may have a drum shape, and may be rotated around the axis at a predetermined circumferential speed. While the organic photoreceptor is rotated, a circumferential surface of the organic photoreceptor may be uniformly charged with a predetermined positive (+) or negative (−) potential by a charging device. The applied voltage may be, for example, an oscillating voltage including superposed direct current (DC) and alternate current (AC) voltages. A charging device may be a contact-type charging device that makes a charging member to contact the organic photoreceptor to charge the organic photoreceptor. Upon slit exposure or laser beam scanning exposure using an exposure system, an electrostatic latent image may be consequently formed on the circumferential surface of the organic photoreceptor. The electrostatic latent image may be converted into a toner image by a developing device, and the toner image may then be transferred onto a transfer member.

According to another aspect of the present disclosure, an electrophotographic cartridge may be configured by integrating a plurality of elements, including an organic photoreceptors according to any of the above-described embodiments, a charging device or member, and a developing device or member. The electrophotographic cartridge may be detachably installed into a main body of an electrophotographic imaging apparatus such as a copying machine or a laser beam printer.

According to another aspect of the present disclosure, an electrophotographic imaging apparatus includes an organic photoreceptor according to any of the above-described embodiments, a charging device or member for charging the organic photoreceptor, an exposure device or member, and a developing device or member.

Embodiments of the organic photoreceptor including a protective layer as described above are not limited to the above. The organic photoreceptor may be implemented in other various forms, for example, with a different structure of the photosensitive layer or with or without the intermediate layer.

Hereinafter, electrically conductive substrates, photosensitive layers, and intermediate layers of the organic photoreceptors according to embodiments will be described in greater detail.

Laminated Organic Photoreceptor

FIG. 1 is a schematic cross-sectional view illustrating a structure of an organic photoreceptor according to an embodiment of the present disclosure. Referring to FIG. 1, the organic photoreceptor may be a laminated organic photoreceptor including a photosensitive layer 4 having a laminated structure including a charge generating layer (CGL) 5 that includes a charge generating material (CGM) 2, a charge transporting layer (CTL) 6 that includes a charge transporting material (CTM) 3 and a binder resin for binding the CTM 3, and a protective layer 9 are sequentially laminated in the stated order on a sheet-type electrically conductive substrate 1 formed of a conductive material.

The CGM 2 and the CTM 3 may be uniformly distributed in the components, such as the binder resin, of the CGL 5 and the CTL 6, respectively, although this is shown in an exaggerated fashion in FIG. 1.

As described above, the photosensitive layer 4 may have a laminated structure of the CGL 5 including the CGM 2, and the CTL 6 including the CTM 3. Due to the provision of the separate layers for charge generation and charge transport functions, i.e., the CGL 5 and the CTL 6, optimum materials for each of these functions may be selected. Accordingly, the organic photoreceptor may have improved sensitivity. The organic photoreceptor may also have improved durability such that its properties remain stable even after repeated use.

Electrically Conductive Substrate

The conductive material of the electrically conductive substrate 1 may be a metallic material, for example, aluminum, an aluminum alloy, copper, zinc, silver, gold, stainless steel, and titanium, but is not limited thereto. For example, the conductive material of the electrically conductive substrate 1 may be a polyester such as polyethylene terephthalate, nylon such as Nylon 6 or Nylon 66, or other polymeric material, such as polystyrene, polycarbonate, a phenolic resin, and polyimide; or hard paper or glass with, on its surface, a laminated or deposited metal film of aluminum, an aluminum alloy, copper, zinc, silver, gold, stainless steel, and/or titanium and so forth; or, on its surface, with a deposited or coated conductive metal oxide layer thereon of a conductive material, tin oxide, indium oxide, and/or tin indium oxide and so forth. Alternatively, those in which the metallic material or conductive metal oxide particle included in the polymeric material forms a conducting path may be used as the electrically conductive substrate 1.

The electrically conductive substrate 1 of the organic photoreceptor may have a sheet form, as illustrated in FIG. 1, but is not limited thereto. For example, the electrically conductive substrate 1 may have a cylindrical form or an endless belt form.

A surface of the electrically conductive substrate 1 may undergo a surface treatment using an anodic oxidation, chemicals, or a hydrothermal method; coloring treatment; or surface roughening treatment for inducing diffused reflection.

In an electrophotographic process using laser as an exposure light source, an incident laser beam may interfere with reflected light from the organic photoreceptor, thus generating an interference pattern that may cause an image defect. However, such an image defect caused by the interference of the laser light may be prevented through the above-described processes.

Charge Generating Layer (CGL)

The CGL 5 may include the CGM 2 for generating charges through light absorption, as a main component.

Charge Generating Material (CGM)

Non-limiting examples of the CGM include azo pigments, such as monoazo pigments, bisazo pigments, and trisazo pigments; indigo pigments such as indigo and thioindigo; perylene pigments, such as perylene imide, and perylenic acid anhydride; polycyclic quinone pigments, such as anthraquinone and pyrenequinone; phthalocyanine pigments, such as metal phthalocyanine and metal-free phthalocyanine; squarylium dyes; pyrylium salts and thiopyrylium salts; triphenylmethane pigments; and inorganic materials such as selenium (Se) and amorphous silicon (Si). These materials may be used alone or in a combination of at least two thereof as the CGM.

For example, oxotitanium phthalocyanine or oxo-titanyl phthalocyanine (TiOPc) from the above group of materials may be used as the CGM. Oxotitanium phthalocyanine is a CGM having high charge generation and charge injection efficiencies, and thus generates a large amount of charges through light absorption. At the same time, it efficiently injects the generated charges into the CTM 3, while not accumulating the generated charges therein.

The CGM 2 may be sensitized with sensitizing dyes, for example, triphenylmethane dyes, such as Methyl Violet, Crystal Violet, Night Blue, and Victoria Blue; acridine dyes, such as Erythrocin, Rhodamine B, Rhodamine 3R, Acridine Orange, and Flapeosine; thiazine dyes, such as Methylene Blue and Methylene Green; oxazine dyes, such as such as Capri Blue and Meldola's Blue; cyanine dyes; styryl dyes; and pyrylium salt dyes or thiopyrylium salt dyes.

Binder Resin for CGL

The binder resin for the CGL 5 may be, for example, one or a combination of at least two selected from a polyester, a polystyrene, a polyurethane, a phenolic resin, an alkyd resin, a melamine resin, an epoxy resin, a silicone resin, an acrylic resin, a methacrylic resin, a polycarbonate, a polyacrylate, a phenoxy resin, a polyvinyl butyral, and a polyvinyl formal, and a copolymer resin including at least two different repeating units of the foregoing resins.

Non-limiting examples of the copolymer resins include insulating resins, for example, a vinyl chloride-vinyl acetate copolymer, a vinyl chloride-vinyl acetate-maleic anhydride copolymer, and an acrylonitrile-styrene copolymer. For example, the binder may be a resin commonly used in the field.

Solvent for CGL Coating Solution

Non-limiting examples of the solvent for preparing a CGL coating solution include a halogenated hydrocarbon, including dichloromethane and dichloroethane; ketones, including acetone, methyl ethyl ketone, and cyclohexanone; an ester, including ethyl acetate and butyl acetate; an ether, including tetrahydrofuran (THF) and dioxane; an ethylene glycol alkyl ether, including 1,2-dimethoxyethane; an aromatic hydrocarbon, including benzene, toluene, and xylene; or an aprotic polar solvent, including N,N-dimethyl formamide and N,N-dimethyl acetamide. For example, the solvent may be a mixed solvent of at least two of these solvents.

CGL Coating Solution

A mixing ratio of the CGM 2 to the binder resin may be in a range of about 10:90 percent by mass (mass %) to about 99:1 mass %. When the ratio of the CGM 2 to the binder resin is less than 10 mass %, the CGL may have low sensitivity. When the ratio of the CGM 2 to the binder resin is greater than 99 mass %, the CGL 5 may have weak strength, as the CGM 2 may have poor dispersibility, thereby including more large coarse particles and consequently reducing surface charges, other than the surface charges on an area to be erased through exposure. As a result, image defects, such as fogging of images by fine black dots resulting from toner adhesion to white medium (paper), are more likely to occur. For these reasons, the mixing ratio of the CGM to the binder resin may be in the range of about 10:90 mass % to about 99:1 mass %.

CGL Formation Method

The CGL 5 may be formed by a variety of methods, for example, by vacuum deposition of the CGM 2 onto the electrically conductive substrate 1 or by coating a CGL coating solution that is obtained by dispersing the CGM 2 in a solvent, on the electrically conductive substrate 1. For example, the CGL 5 may be formed by coating the CGL coating solution on the electrically conductive substrate 1, wherein the CGL coating solution may be obtained by dispersing the CGM 2 by using a conventional known method in a binder resin solution obtained by mixing a binder resin and a solvent. Hereinafter, this method will be described in greater detail.

Prior to the dispersing of the CGM 2 in the binder resin solution, the CGM 2 may be ground using a grinder. Non-limiting examples of the grinder include a ball mill, a sand mill, an attritor, a vibration mill, and an ultrasonic dispersing device.

Non-limiting examples of the dispersing device used to disperse the CGM 2 in the binder resin solution include a paint shaker, a ball mill, or a sand mill. The dispersion conditions may be appropriately selected to prevent incorporation of impurities generated from abrasion of a container used and the elements of the dispersing device.

Non-limiting examples of the method of coating the CGL coating solution obtained by dispersing the CGM 2 in the binder resin solution include a spray method, a bar coating method, a roll coating method, a blade coating method, a ring coating method, and a dip coating method. An appropriate method may be selected from these coating methods depending on the physical properties of the CGL coating solution and productivity, and so forth.

The dip coating method may be used to form a layer, i.e., the CGL in this case, on the electrically conductive substrate 1 by dipping the electrically conductive substrate 1 in a bath filled with a coating solution, i.e., the CGL coating solution in this case, and then drawing the same up from the bath at a constant speed or varying speeds. This method is relatively simple and is advantageous in terms of productivity and costs, and thus is mainly used in manufacturing an organic photoreceptor. An apparatus used in the dip coating method may be equipped with a coating solution dispersing device such as an ultrasonic wave generator to stabilize the dispersibility of the coating solution.

The CGL 5 may have a thickness of about 0.05 micrometers (μm) or greater to about 5 μm or less, and in some embodiments, about 0.1 μm or greater to about 1 μm or less. When the thickness of the CGL 5 is less than 0.05 μm, the charge generating layer may have reduced light absorption efficiency and consequently reduced sensitivity. When the thickness of the CGL 5 is greater than 5 μm, charge migration inside of the CGL may be a rate-determining step of the process of erasing surface charges of the organic photoreceptor, to thereby lower the sensitivity of the organic photoreceptor.

CTL

The CTL 6 may be obtained by incorporating the CTM 3 that may take up and transport the charges generated by the CGM 2 in a binder resin.

CTM

Non-limiting examples of charge transporting materials (CTMs) include a carbazole derivative, a butadiene derivative, an oxazole derivative, an oxadiazole derivative, a thiazole derivative, a thiadiazole derivative, a triazole derivatives, an imidazole derivative, a pyrazolone derivative, an imidazole derivative, an imidazolidine derivative, a bisimidazolidine derivative, a styryl compound, a hydrazone compound, a polycyclic aromatic compound, an indole derivative, a pyrazoline derivative, an oxazolone derivative, a benzimidazole derivative, a quinazoline derivative, a benzofuran derivative, an acridine derivative, a phenazine derivative, an aminostilbene derivative, a triarylamine derivative, a triarylmethane derivative, a phenylenediamine derivative, a stilbene derivative, and a benzidine derivative. A polymer including a moiety derived from these compounds in a backbone or side chain, for example, poly-N-vinyl carbazole, poly-1-vinyl pyrene, and poly-9-vinyl anthracene, may also be used as the CTM.

Binder Resin for CTL

The binder resin used in the CTL 6 may be a binder resin having good compatibility with the CTM 3. Non-limiting examples of the binder resin include a vinyl polymer, including polymethyl methacrylate, polystyrene, polyvinylchloride, and copolymers thereof; and resins, including a polycarbonate, a polyester, a polyester carbonate, a polysulfone, a phenoxy resin, an epoxy resin, a silicone resin, a polyarylate, a polyamide, a polyether, a polyurethane, a polyacrylamide, and a phenolic resin. For example, the binder resin may be a partially cross-linked thermosetting resin selected from the above group of resins.

These resins may be used alone or in a combination of at least two. For example, the binder resin may be a polystyrene, a polycarbonate, a polyarylate, or a polyphenylene oxide that have a volume resistance of about $10^{13}$ ohms (Ω) or greater, good electrical insulating property, good film formability, and good potential characteristics.

The amounts of the CTM and the binder resin in the CTL 6 are not particularly limited, and may be selected as desired based on the knowledge available to commonly used in the art. For example, the amount of the CTM may be in a range of about 10 parts to about 200 parts by mass, and in some embodiments, about 20 parts to about 150 parts by mass, based on 100 parts by mass of the binder resin. When the amount of the CTM is within the range of about 10 parts to about 200 parts by mass, the CTL 6 may have sufficient charge transport ability and consequently prevent a residual potential increase caused due to reduced sensitivity, and may have improved mechanical strength.

Additive for CTL

To improve film formability, flexibility, and surface smoothness of the CTL 6, a platicizer or a leveling agent may be added to form the CTL 6. Non-limiting examples of the platicizer include a dibasic acid ester, a fatty acid ester, a phosphoric acid ester, a phthalic acid ester, a chlorinated paraffin, and an epoxy-type plasticizer. An example of the leveling agent is a silicone leveling agent.

To improve the mechanical strength or electrical characteristics of the CTL 6, particles of an inorganic compound or an organic compound may be added. Any of a variety of additives, for example, an antioxidant and a sensitizing agent may be added to form the CTL 6, if needed. This may improve potential characteristics of the organic photoreceptor and stability of the coating solution for the charge transporting layer 6, and may reduce fatigue deterioration due to repeated use of the organic photoreceptor and also improve the durability of the organic photoreceptor.

An example of the antioxidant may be a hindered phenol derivative or a hindered amine derivative. An amount of the hindered phenol derivative may be in a range of about 0.1 mass % to about 50 mass % base on the amount of the CTM 3. For example, a mixture of a hindered phenol derivative and a hindered amine derivative may be used. A total amount of the hindered phenol derivative and the hindered amine derivative may be in a range of about 0.1 mass % to about 50 mass % based on the amount of the CTM 3. When the amount of the hindered phenol derivative or the hindered amine derivative, or the total amount of the two is less than 0.1 mass %, improvements in the stability of the coating solution for the CTL and the durability of the organic photoreceptor may not be satisfactory. When the amount of the hindered phenol derivative or the hindered amine derivative or the total amount of the two is greater than 50 mass %, the characteristics of the organic photoreceptor may be adversely affected.

CTL Formation Method

The CTL 6 may be formed by the same method used to form the CGL 5. For example, the CTM 3 and a binder resin, and if required, any of the above-described additives may be dissolved or dispersed in an appropriate solvent to prepare a CTL coating solution. The CTL coating solution may be coated on the CGL 5 by using a spray method, a bar coating method, a roll coating method, a blade coating method, a ring coating method, or a dip coating method to form the CTL 6. The dip coating method, among these coating methods, has a variety of advantages as described above, and thus is mainly used to form the CTL 6.

An appropriate solvent for the CTL coating solution may be one or a mixture of at least two selected from an aromatic hydrocarbons, including benzene, toluene, xylene, and monochlorobenzene; halogenated hydrocarbons, including dichloromethane and dichloroethane; ethers, including THF, dioxane and dimethoxyethane ether; and aprotic polar solvents, such as N,N-dimethylformamide. A solvent such as an alcohol, acetonitrile, or methyl ethyl ketone may be added to such a solvent as described above if needed.

The CTL 6 may have a thickness of about 5 μm or greater to about 50 μm or less, and in some embodiments, about 10 μm or greater to about 40 μm or less. When the thickness of the CTL 6 is less than 5 μm, the organic photoreceptor may have poor surface charge retainability. When the thickness of the CTL 6 is greater than 50 μm, the organic photoreceptor may have poor resolution.

Additive for Photosensitive Layer

To improve sensitivity and suppress a residual potential increase and fatigue resulting from repeated use, at least one electron accepting material or a colorant may be further added to the photosensitive layer 4.

Non-limiting examples of the electron accepting material include an electron attracting material, for example, an anhydride, including succinic anhydride, maleic anhydride, phthalic anhydride, and 4-chlorophthalic anhydride; a cyano compound, including tetracyanoethylene, terephthalic acid dinitrile, and malonic acid dinitrile; an aldehyde, including 4-nitrobenzaldehyde; an anthraquinone, including anthraquinone and 1-nitroanthraquinone; a polycyclic or heterocyclic nitro compounds, including 2,4,7-trinitrofluorenone and 2,4,5,7-tetranitrofluorenone; and a diphenoquinone compound, and a polymerization product of at least one of these electron attracting materials.

Non-limiting examples of the colorant include an organic photoconductive compound, for example, a xanthane dye, a thiazine dye, a triphenylmethane dye, a quinoline pigment, and copper phthalocyanine. These organic photoconductive compounds may serve as optical sensitizing agents.

The organic photoreceptor may further include a protective layer 9 disposed on a surface of the photosensitive layer 4. The protective layer 9 may improve the wear resistance of the photosensitive layer 4 and may protect the photosensitive layer 4 from the chemical attack of ozone or nitrogen oxides generated during charging of the surface of the organic photoreceptor by a corona discharge. The protective layer 9 may be a layer including, for example, a resin, an inorganic filler-containing resin, or an inorganic oxide.

Intermediate Layer

Figure 2:
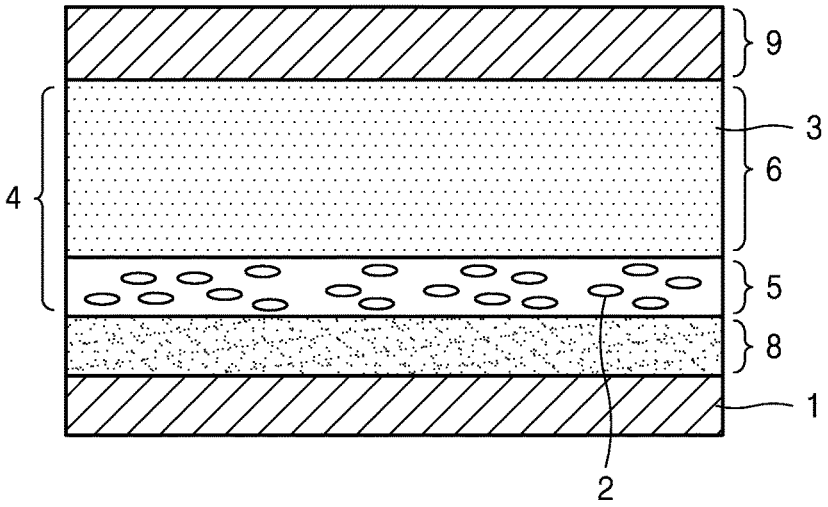
FIG. 2 is a schematic cross-sectional view illustrating a structure of an organic photoreceptor according to another embodiment.

FIG. 2 is a schematic cross-sectional view illustrating a structure of an organic photoreceptor according to another embodiment of the present disclosure. Referring to FIG. 2, the organic photoreceptor of FIG. 2 is similar to the organic photoreceptor of FIG. 1, and elements equivalent to those in FIG. 1 are denoted by the like reference numerals as those used in FIG. 1, and therefore, are not fully described herein. Unlike the organic photoreceptor of FIG. 1, the organic photoreceptor of FIG. 2 may further include an intermediate layer 8 between the electrically conductive substrate 1 and the photosensitive layer 4.

When the intermediate layer 8 is not present between the electrically conductive substrate 1 and the photosensitive layer 4, the charging characteristics of the photosensitive layer 4 may be deteriorated due to the injection of charges from the electrically conductive substrate 1. Accordingly, the surface charges of the photosensitive layer 4, excluding the surface charges on an area to be erased through exposure, may be reduced, which causes image defects, such as fogging of images. When forming an image by using a phase inversion development process in which a toner image forms on the site of which surface charges have been reduced through exposure to light, if surface charges have been reduced through a cause other than exposure to light, fogging of images due to fine black dots resulting from toner adhesion to white medium (paper) may occur, which causes serious image quality deterioration. That is, a defect of the electrically conductive substrate 1 or the photosensitive layer 4 may deteriorate the charging characteristics in a small area of the electrically conductive substrate 1 or the photosensitive layer 4, and consequently cause fogging of images and serious image defects.

As described above, the inclusion of the intermediate layer 8 may prevent charges from the electrically conductive substrate 1 from injecting into the photosensitive layer 4, thereby preventing deterioration of the charging characteristics of the photosensitive layer 4, and may also suppress the reduction of surface charges, excluding the surface charges on an area to be erased through exposure, thereby preventing image defects such as image fogging.

The intermediate layer 8 may cover surface defects on the electrically conductive substrate 1, thereby improving the flatness or smoothness of the electrically conductive substrate 1 and the film formability of the photosensitive layer 4. The intermediate layer 8 may also improve the adhesion between the electrically conductive substrate 1 and the photosensitive layer 4, thereby suppressing separation of the photosensitive layer 4 from the electrically conductive substrate 1.

The intermediate layer 8 may be a resin layer including any of a variety of resin materials, or an alumite layer. Non-limiting examples of the resin materials for the intermediate layer 8 include a resin, including polyethylene, polypropylene, polystyrene, an acrylic resin, vinyl chloride resin, vinyl acetate resin, a polyurethane, an epoxy resin, a polyester, a melamine resin, a silicone resin, a polyvinyl butyral, and a polyamide, copolymer resins including at least two repeating units of the forgoing resins, casein, gelatin, polyvinyl alcohol, and ethyl cellulose.

For example, the intermediate layer 8 may be a layer including a polyamide resin, for example, an alcohol-soluble nylon resin. Non-limiting examples of the alcohol-soluble nylon resin include a copolymerized nylon obtained by copolymerization of, for example, nylon-6, nylon-6,6, nylon-6,10, nylon-11, and/or nylon-12; and a chemically-modified nylon resin, for example, N-alkoxymethylated nylon and N-alkoxyethylated nylon.

The intermediate layer 8 may include metal oxide particles that allow adjusting of a volume resistance thereof and further prevent the charges from the electrically conductive substrate 1 from injecting into the photosensitive layer 4, and at the same time maintain electrical characteristics of the organic photoreceptor under various environmental conditions. Non-limiting examples of the metal oxide particles include titanium oxide particles, aluminum oxide particles, aluminum hydroxide particles, and tin oxide particles.

The intermediate layer 8 including the metal oxide particles may be formed by coating an intermediate layer coating solution that may be prepared by dispersing the metal oxide particles in a resin solution described above, onto the electrically conductive substrate 1. Non-limiting examples of a solvent for the resin solution include water and/or various organic solvents. For example, the solvent for the resin solution may be a single solvent, such as water, methanol, ethanol, or butanol; a mixed solvent of water and an alcohol, a mixed solvent of at least two alcohols, a mixed solvent of acetone and an alcohol, such as dioxolane, and a mixed solvent of an alcohol and a chlorinated solvent, such as dichloroethane, chloroform, and trichloroethane.

The dispersing of the metal oxide particles in the resin solution may be performed by any conventional method using a ball mill, a sand mill, an attritor, a vibration mill, or an ultrasonic dispersing device.

A ratio (C/D) of a total amount (C) of the resin and the metal oxide particles in the intermediate layer coating solution to an amount (D) of the solvent in the intermediate layer coating solution may be in a range of about 1:99 mass % to about 40:60 mass %, and in some embodiments, about 2:98 mass % to about 30:70 mass %. A ratio of the resin to the metal oxide particles may be in a range of about 90:10 mass % to about 1:99 mass %, and in some embodiments, about 70:30 mass % to about 5:95 mass %.

A method of coating the intermediate layer coating solution may be, for example, a bar coating method, a roll coating method, a blade coating method, a ring coating method, or a dip coating method. As described above, the dip coating method is relatively simple and advantageous in terms of productivity and costs, and thus is mainly used to form the intermediate layer 8.

The intermediate layer 8 may have a thickness of about 0.01 μm or greater up to about 20 μm or less, and in some embodiments, about 0.05 μm or greater up to about 10 μm or less. When the thickness of the intermediate layer 8 is smaller than 0.01 μm, the intermediate layer 8 may not function properly to coat surface defects on the electrically conductive substrate 1, thereby failing to provide a flat or smooth surface of the electrically conductive substrate 1 and to prevent charges from the electrically conductive substrate 1 from injecting into the photosensitive layer 4, and the charging characteristics of the photosensitive layer 4 may be deteriorated. When the thickness of the intermediate layer 8 is greater than 20 μm, the workability of forming the intermediate layer 8 by a dip coating method may be lowered, and the photosensitive layer 4 may not be uniformly formed on the intermediate layer 8, thereby making the sensitivity of the organic photoreceptor prone to decrease.

Single-Layered Organic Photoreceptor

Figure 3:
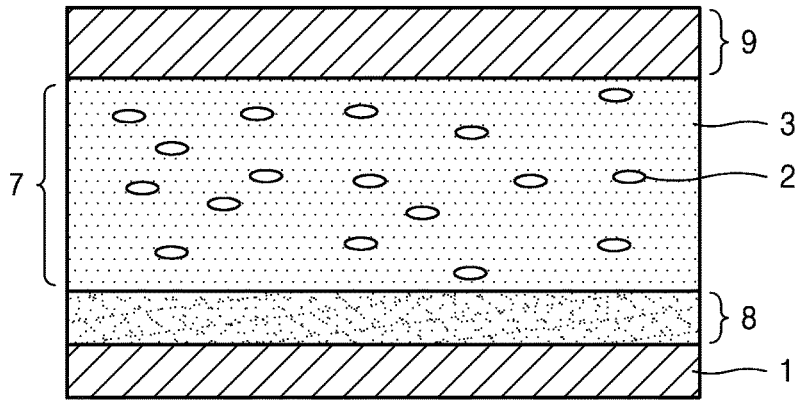
FIG. 3 is a schematic cross-sectional view illustrating a structure of an organic photoreceptor according to another embodiment.

FIG. 3 is a schematic cross-sectional view illustrating a structure of an organic photoreceptor according to another embodiment of the present disclosure. Referring to FIG. 3, the organic photoreceptor of FIG. 3 is similar to the organic photoreceptor of FIG. 2. Elements equivalent to those in FIG. 2 are denoted by the like reference numerals as those used in FIG. 2 and are not fully described here. Unlike the organic photoreceptor of FIG. 2, the organic photoreceptor of FIG. 3 is a single-layered organic photoreceptor including a photosensitive layer 7 that has a single-layered structure including a CGM 2 and a CTM 3 along with a binder resin in the same layer.

The photosensitive layer 7 may be formed in the same manner as the CTL 6 of the previous embodiment of FIG. 2. For example, the CGM 2, the CTM 3, and a binder resin may be dissolved or dispersed in an appropriate solvent to prepare a photosensitive layer coating solution. The photosensitive layer coating solution may be coated on the intermediate layer 8 by using, for example, a dip coating method, to form the photosensitive layer 7.

A mass ratio of the CTM 3 to the binder resin in the photosensitive layer 7 may be the same as that of the CTM 3 to the binder resin in the CTL 6. A mass ratio of the CGM 2 to the binder resin in the photosensitive layer 7 may be the same as that of the CGM 2 to the binder resin in the CGL 5.

The photosensitive layer 7 may have a thickness of about 5 μm or greater up to about 100 μm or greater, and in some embodiments, about 10 μm or greater up to about 50 μm or less. When the thickness of the photosensitive layer 7 is less than 5 μm, the surface charge retaining ability of the organic photoreceptor may be deteriorated. When the thickness of the photosensitive layer 7 is greater than 100 μm, productivity of preparing the photosensitive layer 7 may be lowered.

In some embodiments, the organic photoreceptor may have any of a variety of layered structures, and is not limited to the structures of FIGS. 1 to 3 described above.

Each of the layers of the organic photoreceptor according to any of the above-described embodiments may further include any of a variety of additives, for example, an antioxidant, a sensitizing agent, and/or an ultraviolet ray absorbent, if needed. This may improve potential characteristics of the organic photoreceptor, the stability of a coating solution used to form the layer by coating, and may suppress fatigue deterioration resulting from repeated use of the organic photoreceptor, thereby improving the durability of the organic photoreceptor.

Non-limiting examples of the antioxidant include a phenolic compound, for example, a hindered phenol derivative, a hydroquinone compound, a tocopherol compound, and an amine compound, for example, a hindered amine derivative. The amount of the antioxidant may be in a range of about 0.1 mass % or greater to about 50 mass % or less based on the amount of the CTM 3. When the amount of the antioxidant is less than 0.1 mass %, satisfactory stability of the coating solution and the durability of the organic photoreceptor may not be achieved. When the amount of the antioxidant is greater than 50 mass %, the characteristics of the organic photoreceptor may be deteriorated.

According to another aspect of the present disclosure, an electrophotographic imaging apparatus includes any of the organic photoreceptors according to the above-described embodiments. Electrophotographic imaging apparatuses according to embodiments of the present disclosure will now be described in greater detail, but are not limited thereto.

Figure 4:
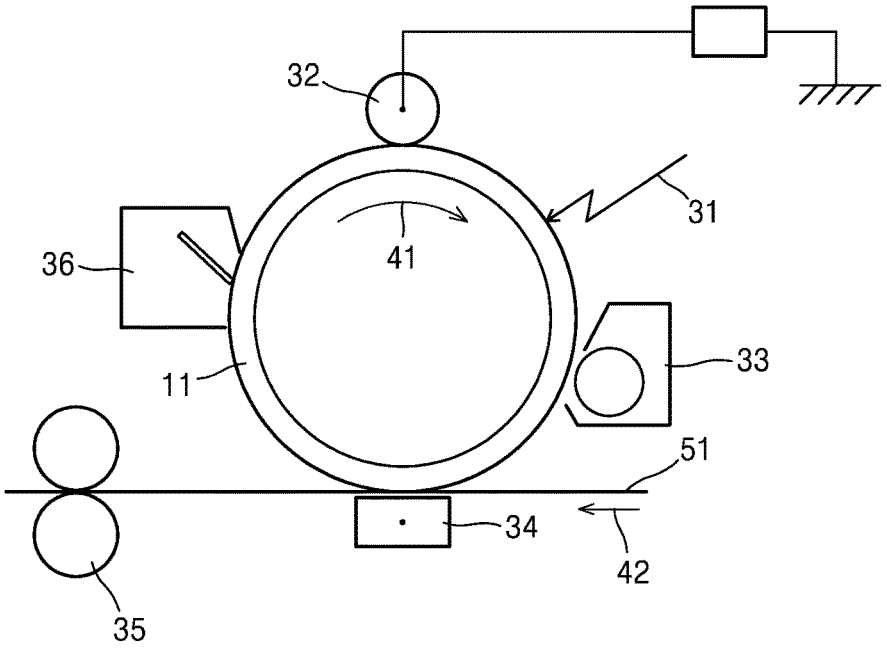
FIG. 4 is a schematic cross-sectional view illustrating a structure of an electrophotographic imaging apparatus including an organic photoreceptor according to an embodiment.

FIG. 4 is a schematic cross-sectional view illustrating a structure of an electrophotographic imaging apparatus according to an embodiment of the present disclosure that includes an organic photoreceptor 11 according to an embodiment of the present disclosure.

Referring to FIG. 4, the electrophotographic imaging apparatus may include an organic photoreceptor 11 according to an embodiment of the present disclosure. The organic photoreceptor 11, which has a drum or cylindrical shape, may be rotated at a specific circumferential speed in a direction indicated by reference numeral 41 by a driving unit (not shown). A charger 32, a semiconductor laser (not shown), a developer 33, a transfer charger 34, and a cleaner 36 may be sequentially disposed around the organic photoreceptor 11 along the rotation direction of the organic photoreceptor 11. A fixing unit 35 may be installed in a forward direction of a transfer medium 51.

An imaging process of the electrophotographic imaging apparatus will be described in detail. First, a surface of the organic photoreceptor 11 may be uniformly charged by applying a positive or negative voltage by using the charger 32 that may be a contact-type or non-contact type, and then may be exposed to a laser beam 31 radiated from the semiconductor laser. The laser beam 31 may repeatedly scan the surface of the organic photoreceptor 11 in a main scanning direction, i.e., a lengthwise direction of the organic photoreceptor 11 to form an electrostatic latent image on the surface of the organic photoreceptor 11. The electrostatic latent image may be developed into a toner image by the developer 33 that is installed downward next to an irradiation zone of the laser beam 31 along the rotation direction of the organic photoreceptor.

In synchronization with the exposure of the organic photoreceptor 11 to the laser beam 31, the transfer medium 51 may be moved in a direction indicated by reference number 42 toward the transfer charger 34 that is installed downward next to the developer 33 along the rotation direction of the organic photoreceptor, while the toner image formed on the surface of the organic photoreceptor 11 by the developer 33 may be transferred onto a surface of the transfer medium 51 by the transfer charger 34. The transfer medium 51 with the transferred toner image thereon may be moved to the fixing unit 35 by a conveyer belt (not shown), and the toner image may be fixed onto the transfer medium 51 by the fixing unit 35 to form a part of the final image.

The toner remaining on the surface of the organic photoreceptor 11 may be removed by an erasing lamp (not shown) and a cleaner 32 that are installed in a downward rotation direction of the transfer charger 34 and an upward rotation direction of the charger 32. These imaging processes may be repeated during the continuous rotating of the organic photoreceptor 11, so that a final image may be formed on the transfer medium 51. The transfer medium 51 with the final image thereon may be discharged out of the electrophotographic imaging apparatus.

As described above, the organic photoreceptor of an electrophotographic imaging apparatus according to an embodiment may include a protective layer that includes a composite structure obtained by introducing a polymerization product of a multifunctional curable compound having a dendrimeric structure into a 3-dimensional crosslinked structure obtained from the reaction of multifunctional acrylic oligomers having a urethane group, and thus may have conflicting characteristics including high hardness, as well as high toughness, high elasticity, and good internal stress relaxation.

Accordingly, the organic photoreceptor including a photosensitive layer may have improved durable mechanical characteristics in terms of resistance to plate wear, scratch resistance, and wear resistance. Therefore, the organic photoreceptor according to any of the above-described embodiments may stably provide high-quality images even when repeatedly used for a long period of time.

One or more embodiments of the present disclosure will now be described in detail with reference to the following examples. However, these examples are only for illustrative purposes and are not intended to limit the scope of the one or more embodiments of the present disclosure.

Example 1

30 grams (g) of a Nylon 6-66-610 terpolymer (SVP-651, available from Shakespeare Co., Ltd) having a saturation water absorptivity of 2.5% was dissolved in 235 g of a mixed alcohol solvent (methanol:1-propanol=8:2 by weight) to obtain a nylon copolymer solution. 265 g of a mixed alcohol slurry (solid content: 17.0 mass %) in which titanium dioxide particles (TTO-55N, available from Ishihara Industries Co, Ltd.) having an average primary particle diameter of about 30 nanometers (nm) to about 50 nm, not surface-treated, were dispersed using a ball mill was added to the nylon copolymer solution and then mixed. The mixture was further dispersed using an ultrasonic wave to obtain a coating composition for forming an intermediate layer. The coating composition had a solid content of about 15 mass % and comprised titanium dioxide particles (TTO-55N) and the nylon copolymer in a weight ratio of about 1.5:1.

9.5 parts by mass of τ-type metal-free phthalocyanine particles and 0.5 parts by weight of γ-type titanyloxy phthalocyanine (γ-TiOPc) particles were mixed with 5 parts by mass of a polyvinylbutyral (PVB) binder resin (PVB 6000-C, Denki Kagaku Kogyo Kabushiki Kaisha) and 100 parts by mass of tetrahydrofuran (THF). The mixture was sand-milled for about two hours and then ultrasonically treated to obtain a coating composition for forming a charge generating layer (CGL).

51 parts by weight of Compound (1) and 27 parts by mass of Compound (2) as a charge transporting material, 100 parts by mass of a polycarbonate resin (B500, available from Idemitsu Kosan Co., Ltd.) and 0.1 parts by mass of silicone oil (KF-50, available from Shin-Etsu Co., Ltd. in Japan) were dissolved in a mixed solvent of 534 parts by mass of THF and 178 parts by weight of toluene to obtain a coating composition for forming a charge transporting layer (CTL).

(1)

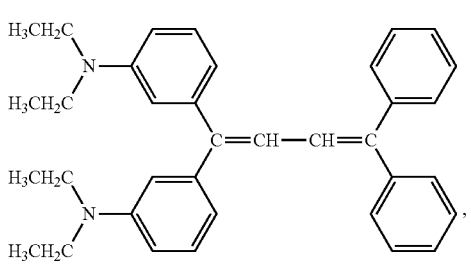

(2)

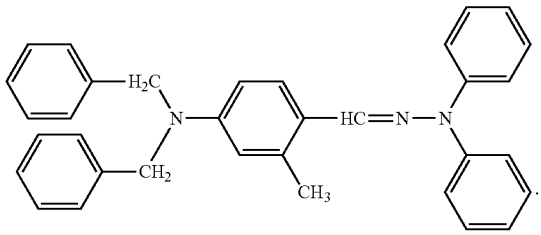

The coating composition for forming an intermediate layer was coated using a dip coating method on an aluminum drum having an external diameter of about 24 millimeters (mm), a length of about 248 mm, and a thickness of about 1 mm and then dried to form an intermediate layer having a thickness of about 1.2 μm. The coating composition for forming a CGL was coated using a dip coating method on the intermediate layer of the aluminum drum and then dried to form a charge generating layer having a thickness of about 0.4 μm on the intermediate layer. The coating composition for forming a CTL was coated using a dip coating method on the CGL of the aluminum drum and then dried to form a charge transporting layer having a thickness of about 20 μm on the CGL.

A coating solution for forming a protective layer was prepared by mixing the following components, coated using a ring coating method on the CTL, dried at about 80° C. for about 5 minutes, and then cured by ultraviolet (UV) radiation at a UV exposure dose of about 850 milliJoules per square centimeter (mJ/cm$^2$) using a metal halide lamp while controlling the radiation intensity and time to form a protective layer having a thickness of about 5 μm on a surface of the CTL, thereby forming an organic photoreceptor.

The coating composition used in Example 1 is:

- a urethane acrylate oligomer (UV-7605B, Mw: 1100, available from Nippon Synthetic Chemical Co., Ltd.): 50 parts by mass,
- a dendrimeric polyester acrylate oligomer (VISCOAT #1000, Mw: 1570, available from Osaka Organic Chemical Ind., Ltd.): 50 parts by mass,
- conductive metal oxide (CELNAX® CX-Z210IP-F2, available from Nissan Chemical Industries): a solid content of 25 parts by mass (20 mass % @ IPA),
- 2,2,2-trifluoroethyl methacrylate (VISCOAT 3FM, available from Osaka Organic Chemical Ind., Ltd.): 5 parts by mass,
- a photopolymerization initiator (2-methyl-1-[4-(methylthio)phenyl]-2-morpholinopropan-1-one, IGACURE 907, available from BASF JAPAN): 5 parts by mass, and
- 1-propanol: 250 parts by mass.

Example 2

A solid content of 50 parts by mass of dendrimeric polyacrylate (STAR-501, Mw: 18100, available from Osaka Organic Chemical Ind., Ltd. 50 mass % @ propylene glycol monomethyl ether acetate), instead of 50 parts by mass of the dendrimeric polyester acrylate oligomer (VISCOAT #1000, Mw: 1570) used in the coating solution for the protective layer of Example 1, was used to prepare a coating solution for a protective layer, followed by ring coating and drying at about 80° C. for about 10 minutes to form a protective layer having a thickness of about 5 μm on a surface of the CTL, thereby forming an organic photoreceptor.

Comparative Example 1

For comparison with the organic photoreceptor of Example 1 having the protective layer including a homogeneous dendrimeric structure introduced into a crosslinked structure of high-molecular weight multifunctional acrylic oligomers, an organic photoreceptor with a protective layer including an inhomogeneous hyperbranched structure introduced into a crosslinked structure of high-molecular weight multifunctional acrylic oligomers was formed.

The organic photoreceptor of Comparative Example 1 was formed in the same manner as in Example 1, except that 50 parts by mass of an inhomogeneous hyperbranched polyester acrylate oligomer (CN2302, Mw: 1270, available from Sartomer Co., Inc.), instead of 50 parts by weight of the dendrimeric polyester acrylate oligomer (VISCOAT #1000) used in the coating solution for the protective layer of Example 1, was used to prepare a coating solution for a protective layer.

Accordingly, the organic photoreceptor of Comparative Example 1 had a protective layer including a cured product resulting from curing of the urethane acrylate oligomer (UV-7605B, available from Nippon Synthetic Chemical Co., Ltd.) and the hyperbranched polyester acrylate oligomer.

Comparative Example 2

An organic photoreceptor was formed in the same manner as in Example 1, except that 50 parts by mass of an acrylate monomer (SR355, Mw: 482, number of acrylic functional groups: 4, available from Sartomer Co., Inc.), instead of 50 parts by mass of the urethane acrylate oligomer (UV-7605B) used in the coating solution for the protective layer of Example 1, was used to prepare a coating solution for a protective layer.

Comparative Example 3

An organic photoreceptor was formed in the same manner as in Comparative Example 1, except that 50 parts by mass of an acrylate monomer (SR355, Mw: 482, number of acrylic functional groups: 4, available from Sartomer Co., Inc.), instead of 50 parts by mass of the urethane acrylate oligomer (UV-7605B) used in the coating solution for the protective layer of Comparative Example 1, was used to prepare a coating solution for a protective layer.

Comparative Example 4

An organic photoreceptor was formed in the same manner as in Example 2, except that 50 parts by mass of an acrylate monomer (SR355, Mw: 482, number of acrylic functional groups: 4, available from Sartomer Co., Inc.), instead of 50 parts by mass of the urethane acrylate oligomer (UV-7605B) used in the coating solution for the protective layer of Example 2, was used to prepare a coating solution for a protective layer.

Characteristics Evaluation

The surface hardness (Martens hardness, HM) and elastic work ratio of each of the organic photoreceptors of Examples 1 and 2 and Comparative Examples 1 to 4 were measured using a Nanorange indentation tester (PICODENTOR® HM500, available from Fisher Instruments) as a microhardness testing machine. While applying a load on an indenter of the tester, an indentation depth from the surface of the organic photoreceptor was continuously read to obtain a surface hardness and an elastic work ratio.

Mechanical characteristics of the cured resin surface layer (protective layer) on the surface of each of the organic photoreceptors were measured using the tester by an indentation load-depth method (indentation test method), while a load was stepwise varied to 0.1 milliNewtons (mN), 0.5 mN, 2 mN, 5 mN, and 10 mN with a triangular diamond indenter. Data of surface hardness (Martens hardness (HM)) and elastic/plastic characteristics (elastic work ratio (nIT)) of the surface layer (protective layer) were obtained based on the results of the mechanical characteristic measurement.

Table 1 shows the surface hardness (Martens hardness (HM)) and elastic/plastic characteristics (elastic work ratio (nIT)) of the organic photoreceptors of Examples 1 and 2 and Comparative Examples 1 to 3. Referring to Table 1, the organic photoreceptors of Examples 1 and 2 had better surface hardness (Martens hardness (HM)) and elastic/plastic characteristics (elastic work ratio (nIT)) than the organic photoreceptors of Comparative Examples 1 to 3. The organic photoreceptor of Comparative Example 4 had slightly better surface hardness (Martens hardness (HM)) and elastic/plastic characteristics (elastic work ratio (nIT)) than the organic photoreceptors of Comparative Examples 1 to 3, but still had a large abrasion loss with an unsatisfactory result from an image quality evaluation, indicating poor durability.

TABLE 1

| Example | Composite crosslinked structure of protective layer (*1) | Mixed ratio (mass %) of acrylate oligomer or monomer/ hyperbranched acrylate | Martens Hardness (HM) (*2) ($N/mm^2$) | Elastic work ratio (*2) nIT (%) | Abrasion loss after printing 60,000 sheets (μm) | Image quality (Durability test) |
|---|---|---|---|---|---|---|
| Example 1 | multifunctional urethane acrylate oligomer + dendrimeric acrylate oligomer | 50/50 | 220 | 64 | 0.6 | good |
| Example 2 | multifunctional urethane acrylate oligomer + dendrimeric acrylate polymer | 50/50 | 283 | 67.5 | 0.51 | good |
| Comparative Example 1 | multifunctional urethane acrylate oligomer + hyperbranched acrylate oligomer | 50/50 | 192 | 60.5 | 0.87 | Defective image found from 55,000$^{th}$ print sheet |
| Comparative Example 2 | acrylate monomer + dendrimeric acrylate oligomer | 50/50 | 171 | 61.2 | 0.98 | Defective image found on 50,000$^{th}$ sheet |
| Comparative Example 3 | acrylate monomer + hyperbranched acrylate oligomer | 50/50 | 162 | 58.3 | 1.15 | Defective image found on 40,000$^{th}$ print sheet, and durability test stopped after printing 45,000$^{th}$ sheet due to severe image defects |
| Comparative Example 4 | acrylate monomer + dendrimeric acrylate polymer | 50/50 | 212 | 63.3 | 0.8 | Defective image found after more than 55,000 sheets |

(*1) The composite crosslinked structure of the surface layer (protective layer) included metal oxide dispersed therein.

(*2) Elastic work ratio (%) = (work done in elastic deformation × 100)/(work done in plastic deformation + work done in elastic deformation), wherein a test load applied with the microhardness testing machine was 2 mN.

Figure 5:
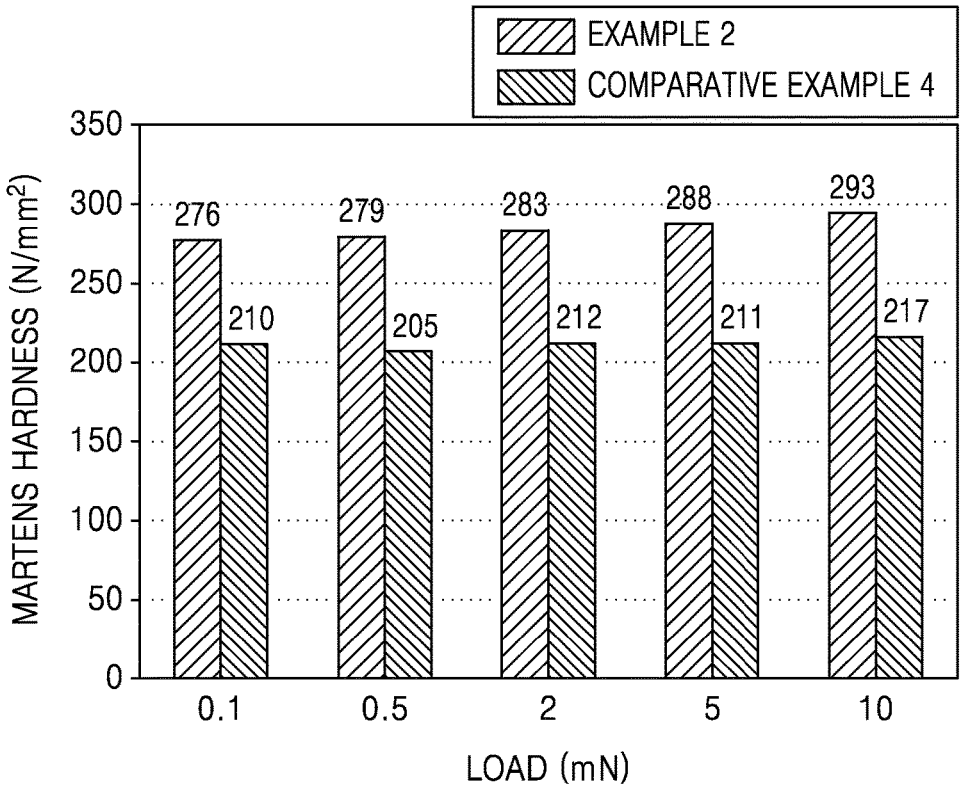
FIG. 5 is a graph of Martens hardness (Newton per square millimeter, $N/mm^2$) versus load (milliNewtons, mN) illustrating surface hardness (Martens hardness (HM)) characteristics at varying loads in organic photoreceptors of Example 2 and Comparative Example 4.
Figure 6:
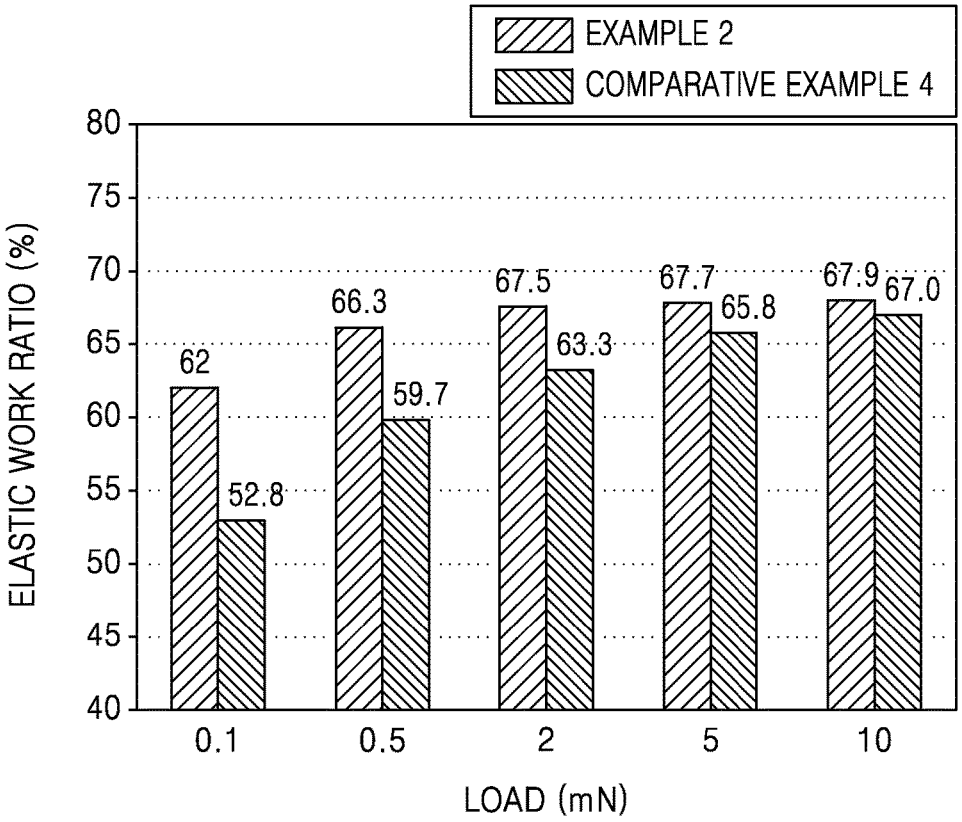
FIG. 6 is a graph of elastic work ratio (percent, %) versus load (milliNewtons, mN) illustrating elastic/plastic (elastic work ratio (nIT)) characteristics at varying loads in the organic photoreceptors of Example 2 and Comparative Example 4.

FIG. 5 is a graph illustrating surface hardness (Martens hardness (HM)) characteristics at varying loads in the organic photoreceptors of Example 2 and Comparative Example 4. FIG. 6 is a graph illustrating elastic/plastic (elastic work ratio (nIT)) characteristics at varying loads in the organic photoreceptors of Example 2 and Comparative Example 4. Referring to FIGS. 5 and 6, the protective layer of the organic photoreceptor of Example 2 (multifunctional acrylate oligomer/dendrimeric acrylate polymer) had a larger hardness and a larger elastic work ratio than those of the protective layer of the organic photoreceptor of Comparative Example 4 (acrylate monomer/dendrimeric acrylate polymer), and a remarkable difference in plastic deformation from the organic photoreceptor of Comparative Example 4. The protective layer of the organic photoreceptor of Example 2 maintained almost constant physical property values at a load of 0.5 mN or greater, indicating a homogeneously cured inner structure after UV curing with reduced surface damage by oxygen.

As described above, according to the one or more of the above embodiments of the present disclosure, an organic photoreceptor may include a protective layer having high hardness, as well as high elasticity, and even good internal stress relaxation characteristics. The organic photoreceptor including such a protective layer may have the following advantages.

(1) In the protective layer, multifunctional acrylic oligomers having a urethane group with a relatively high molecular weight form a 3-dimensional crosslinked structure. This 3-dimensional crosslinked structure includes large molecular chain entanglements due to the use of the multifunctional acrylic oligomer molecules with a relatively high molecular weight. The 3-dimensional crosslinked structure has both covalent crosslinks (chemical crosslink structure) between high-molecular chains resulting from molecular chain extension reaction of the high-molecular weight oligomer molecules during polymerization, and hydrogen bonds (physical crosslink structure) between the urethane groups of the high-molecular chains. Therefore, the protective layer, thus the organic photoreceptor having the protective layer, may have strong hardness as well as high toughness.

(2) The multifunctional curable compound having a dendrimeric structure has a sphere-shaped hyperbranched structure with a sparse-dense structure that includes a hard segment region having a high bonding density at the dendrimer core portion and a soft segment region having a low bonding density at the peripheral portion of the dendrimer. The multifunctional curable compound (oligomer or polymer) having a dendrimeric structure may provide flexibility, and consequently high elasticity and good internal stress relaxation characteristics.

(3) By forming a composite structure via the introduction of a polymerization product of a multifunctional curable compound having a dendrimeric structure into a 3-dimensional crosslinked structure obtained from the reaction of the multifunctional acrylic oligomers having an urethane group with a relatively high molecular weight may provide conflicting characteristics including high hardness, as well as high toughness, high elasticity, and good internal stress relaxation with the organic photoreceptor having the protective layer.

Therefore, the organic photoreceptor including the protective layer may have improved durable mechanical characteristics such as resistance to plate wear, scratch resistance, and wear resistance. Therefore, the organic photoreceptor according to any of the above-described embodiments may stably provide high-quality images even when repeatedly used for a long period of time.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments of the present disclosure have been described with reference to the figures, it will be understood by those of ordinary skill in the art that various changes in form and details may be made therein without departing from the spirit and scope of the present disclosure as defined by the following claims.

What is claimed is:

1. An organic photoreceptor comprising:

a photosensitive layer disposed on an electrically conductive substrate; and a protective layer disposed on the photosensitive layer, wherein the protective layer comprises a cured product of a multifunctional acrylic oligomer comprising a urethane group and a multifunctional curable compound comprising a dendrimeric structure, and wherein the multifunctional acrylic oligomer comprises 3 to 6 polymerizable functional groups, and wherein the cured product is obtained by using 5 to 90 parts by mass of the multifunctional curable compound comprising a dendrimeric structure, based on 100 parts by mass of the multifunctional acrylic oligomer.

2. The organic photoreceptor of claim 1, wherein the multifunctional acrylic oligomer is soluble in an alcoholic solvent, and has a number average molecular weight of about 500 Daltons to about 4,000 Daltons, wherein at least one of the polymerizable functional groups is selected from a radical-polymerizable (meth)acryloyl group and a vinyl group.

3. The organic photoreceptor of claim 1, wherein the multifunctional acrylic oligomer is a urethane (meth)acrylate oligomer comprising a urethane group.

4. The organic photoreceptor of claim 1, wherein the multifunctional curable compound comprising a dendrimeric structure is a polyester (meth)acrylate or a copolymeric poly(meth)acrylate having a peak in a molecular weight range of about 1,000 Daltons or greater to about 25,000 Daltons or less in a molecular weight distribution curve obtained by using a gel permeation chromatography method.

5. The organic photoreceptor of claim 1, wherein the protective layer further comprises a conductive particle.

6. The organic photoreceptor of claim 1, wherein the photosensitive layer is a laminated photosensitive layer comprising a charge generating layer comprising a charge generating material and a charge transporting layer comprising a charge transporting material, wherein the charge generating layer is laminated on the electrically conductive substrate, and wherein the charge transporting layer is laminated on the charge generating layer.

7. The organic photoreceptor of claim 1, wherein the photosensitive layer is a single-layered photosensitive layer disposed on the electrically conductive substrate, wherein the single-layered photosensitive layer comprises a charge generating material and a charge transporting material.

8. The organic photoreceptor of claim 1, further comprising an intermediate layer disposed between the photosensitive layer and the electrically conductive substrate.

9. An electrophotographic cartridge comprising the organic photoreceptor of claim 1.

10. An electrophotographic imaging apparatus comprising the organic photoreceptor of claim 1.

* * * * *